US005117641A

United States Patent [19]

Keltner

[11] Patent Number: 5,117,641

[45] Date of Patent: Jun. 2, 1992

[54] REFRIGERANT RECOVERY SYSTEM WITH FLUSH MODE

[75] Inventor: Robert L. Keltner, Scurry, Tex.

[73] Assignee: Technical Chemical Company, Dallas, Tex.

[21] Appl. No.: 588,561

[22] Filed: Sep. 26, 1990

[51] Int. Cl.[5] ..... F25B 47/00

[52] U.S. Cl. ..... 62/85; 62/292; 62/475

[58] Field of Search ..... 62/77, 85, 292, 149, 62/475, 529; 141/11, 65, 69, 82

[56] References Cited

U.S. PATENT DOCUMENTS

| | | | |
|---|---|---|---|
| 4,261,178 | 4/1981 | Cain . | |
| 4,285,206 | 8/1981 | Koser . | |
| 4,363,222 | 12/1982 | Cain . | |
| 4,364,236 | 12/1982 | Lower et al. . | |
| 4,444,330 | 4/1984 | Lower et al. . | |
| 4,476,688 | 10/1984 | Goddard | 62/292 |
| 4,539,817 | 9/1985 | Staggs et al. . | |
| 4,688,388 | 8/1987 | Lower et al. . | |
| 4,768,347 | 9/1988 | Manz et al. . | |
| 4,805,416 | 2/1989 | Manz et al. . | |
| 4,809,520 | 3/1989 | Manz et al. . | |
| 4,887,435 | 12/1989 | Anderson, Jr. | 62/85 |

FOREIGN PATENT DOCUMENTS

| | | | |
|---|---|---|---|
| 1305510 | 4/1987 | U.S.S.R. | 62/149 |

*Primary Examiner*—Albert J. Makay
*Assistant Examiner*—John Sollecito
*Attorney, Agent, or Firm*—Konneker & Bush

[57] ABSTRACT

A refrigerant recovery apparatus will connect to an air conditioning system for recovering refrigerant when the air conditioning system requires maintenance. The recovery apparatus has a filter dryer for removing moisture and impurities, a compressor for compressing refrigerant recovered, and a condenser for condensing the compressed refrigerant into a liquid. A storage container stores the liquid refrigerant. A liquid pump will connect to the storage container for pumping liquid refrigerant from the storage container. The liquid pump in a flush mode, will pump the liquid refrigerant back through the air conditioning system to flush the air conditioning system of impurities. A return line returns the refrigerant back to the storage container, and filters the refrigerant from impurities. In a cleaning mode, the liquid pump will recirculate the liquid refrigerant from the storage container through the filter dryer and back to the storage container.

9 Claims, 1 Drawing Sheet

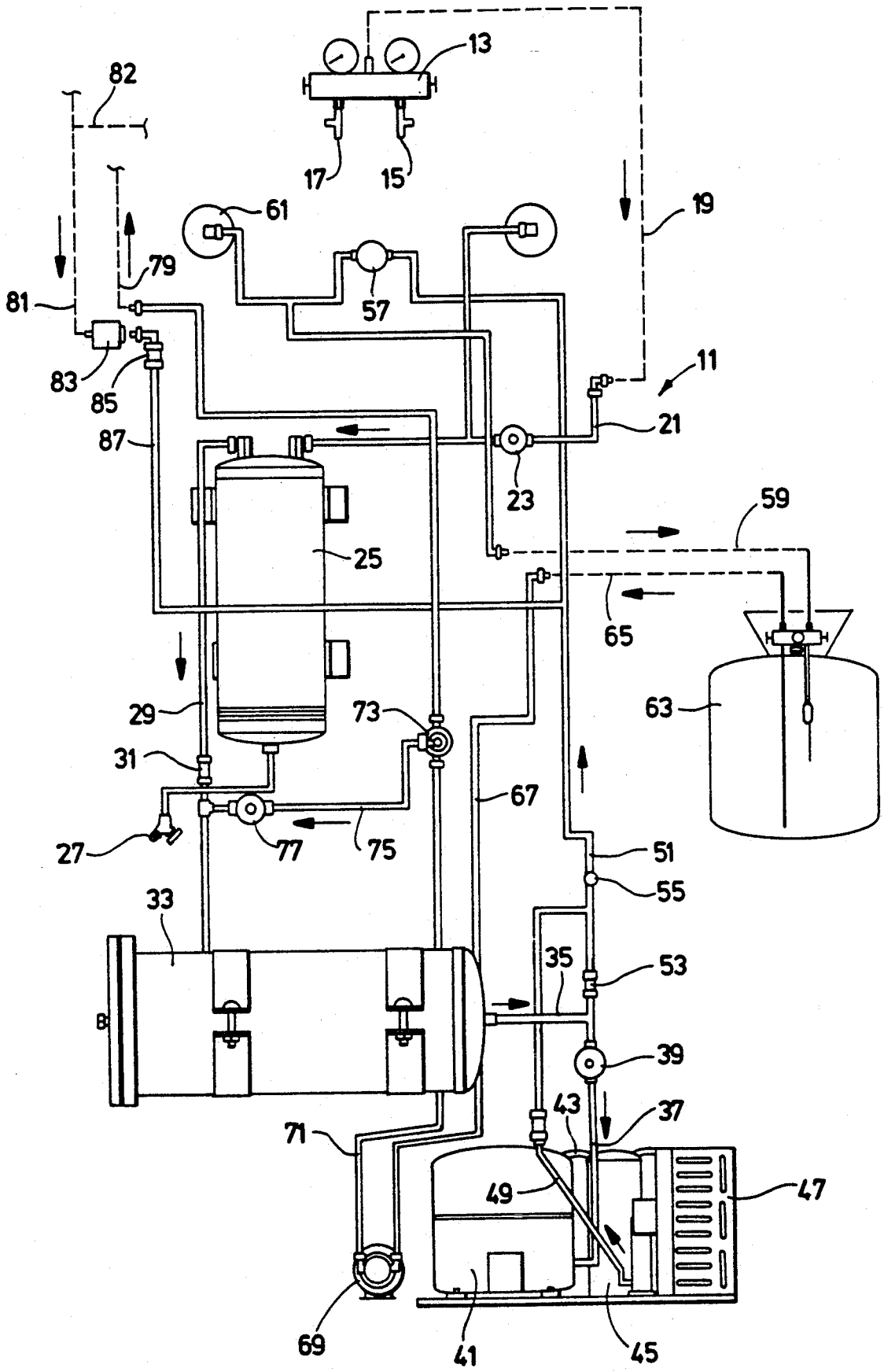
13
82
17
15
61
19
79
57
81
83
85
11
87
21
23
59
25
65
29
73
63
31
67
27
77
75
51
55
33
35
53
39
43
37
71
49
47
69
41
45

REFRIGERANT RECOVERY SYSTEM WITH FLUSH MODE

BACKGROUND OF THE INVENTION

1. Field of the Invention

This invention relates in general to devices for recovering refrigerant from air conditioning systems, and in particular to a device which will also flush the air conditioning system of impurities.

2. Description of the Prior Art

Air conditioning systems such as in vehicles utilize a refrigerant that scientists believe is harmful to the Earth's atmosphere. In the past, when working on an air conditioning system, often the worker would vent the existing refrigerant to atmosphere. Now, these environmental concerns and resulting regulations are requiring many workers to recover the refrigerant, clean it and reuse it.

Prior art refrigerant recovery systems generally utilize an accumulator for trapping oil and liquid refrigerant, a filter dryer for removing moisture and impurities, and a compressor for compressing the gaseous refrigerant into high pressure gaseous refrigerant. A condenser condenses the gaseous refrigerant into liquid refrigerant, which is then placed into a storage container.

It is also known in the prior art to have a cleaning cycle. In the cleaning cycle, the refrigerant will be recirculated out of the storage container, through the recovery apparatus for further filtering and cleaning, then placed back into the storage container.

While these systems will withdraw and clean refrigerant adequately, often, there will be a need to flush the air conditioning system. Because of the failure in the air conditioning system, there may be metal parts, powders and sludge located in the components of the air conditioning system. In the prior art, the worker will discharge an aerosol flush through the air conditioning system. This aerosol flush also utilizes a refrigerant chemical, however. The recycling aerosol flush would be vented to the atmosphere, which could be harmful.

SUMMARY OF THE INVENTION

The recovery apparatus of this invention has a recovery mode, a cleaning mode, and a flushing mode. For the flushing mode, a liquid pump will withdraw stored liquid refrigerant from the storage container This pump has an output that connects to the air conditioning system. The pump will pump the liquid refrigerant through the air conditioning system to flush it of impurities. The system has a return line which will receive the circulating liquid refrigerant pumped by the liquid pump. A filter will filter this refrigerant as it returns to the recovery apparatus. The recovery apparatus will transmit the filtered liquid refrigerant back to the storage container.

In the cleaning mode, the liquid pump will withdraw liquid refrigerant from the storage container, also. In this mode, however, a valve will direct the output from the liquid pump to the filter dryer. The filter dryer will clean the liquid refrigerant. Another valve will direct the output from the filter dryer directly back to the storage container.

BRIEF DESCRIPTION OF THE DRAWING

The sole drawing is a schematic illustrating a recovery apparatus constructed in accordance with this invention.

DETAILED DESCRIPTION OF THE INVENTION

Referring to the drawing. recovery apparatus 11 may utilize a manifold 13. Manifold 13 has a high side connection 15 and a low side connection 17. The connections 15, 17 connect to hoses (not shown) which lead to the high and low sides, respectively, of an air conditioning system (not shown). An intake hose 19 will lead from manifold 13 to an intake line 21 of the recovery apparatus 11.

Intake line 21 has an intake valve 23, which is solenoid actuated to open and close the intake line 21. The refrigerant will flow through the intake line 21, as indicated by the arrow, to an accumulator 25. Accumulator 25 will trap any liquid refrigerant flowing through the intake line 21, as well as trapping oil contained in the air conditioning system. After recovery, an oil drain valve 27 allows the oil to be drained and measured so that the worker will know how much oil was withdrawn from the air conditioning system. Liquid refrigerant contained in the accumulator 25 will boil off into a gas and flow out an accumulator output line 29. An electric heater (not shown) in the accumulator 25 assists in converting liquid refrigerant into gas.

A check valve 31 locates in the accumulator output line 29 to assure flow is only in the direction of the arrow. The accumulator output line 29 leads to a conventional filter dryer 33. Filter dryer 33 will filter the refrigerant of impurities and water moisture. The refrigerant in the filter dryer 33 will be in a gaseous phase. Filter dryer 33 has an output line 35 that leads to a compressor input line 37. A compressor intake valve 39 is solenoid actuated, and will selectively open and close the compressor input line 37. The compressor input line 37 leads to a conventional compressor 41 of a type that will compress a gaseous refrigerant Compressor 41 has an output 43 through which high pressure, hot gaseous refrigerant will be discharged. The output 43 leads to an oil separator 45, which is conventional, and may be considered a part of compressor 41. Oil separator 45 will separate oil contained in the refrigerant being discharged from the compressor 41, this oil being lubricating oil required by the compressor 41. The oil in the oil separator 45 will be returned to the compressor 41 in a conventional manner.

The oil separator 45 connects to a conventional condenser 47. Condenser 47 is a heat exchanger which will have a fan for flowing through finned tubes. The gaseous refrigerant will be cooled by the condenser 47. This cooling results in the gaseous refrigerant converting into a liquid refrigerant at the output line 49.

The condenser output line 49 connects into a storage input line 51. The filter dryer output line 35 also connects to this storage input line 51 in a "T" connection. One leg of the T connection connects to the compressor input line 37, while the other leg of the T connection connects to the storage input line 51. A check valve 53 in storage input line 51 assures flow only in a direction away from compressor 41.

A high pressure switch 55 will monitor the pressure in the storage input line 51. If it exceeds a maximum set amount, then the high pressure switch 55 will turn off the compressor 41. A conventional sight glass 57 in the storage input line 51 enables a worker to visibly determine if gas bubbles are present within the liquid refrigerant in the storage input line 51. The storage input line 51 has an end which will connect to a storage intake hose 59. A high pressure gauge 61 provides an indication of pressure in the storage input line 51.

The storage intake hose 59 will connect to a storage container 63. Storage container 63 is a tank for receiving the liquid refrigerant from the storage input line 51. Storage container 63 preferably has means (not shown) for indicating when the storage container 63 becomes 80 percent full.

A storage withdrawal hose 65 connects to a fitting which extends to the bottom of the storage container 63. The storage withdrawal hose 65 will connect to a storage withdrawal line 67. Line 67 leads to the input side of a liquid pump 69. Liquid pump 69 is designed for pumping liquids, preferably at a rate of about 58 gallons per hour.

Liquid pump 69 has an output connected to a flush line 71. A clean/flush valve 73 connects into the flush line 71 for allowing fluid to continue passing through the flush line 71, during a flushing mode, or for directing the liquid refrigerant to a recirculation line 75 for a cleaning mode. The recirculation line 75 has a solenoid valve 77 that when actuated will selectively open and close the recirculation line 75. The recirculation line 75 connects to the accumulator output line 29 for recirculating liquid refrigerant back into the filter dryer 33.

The end of the flush line 71 is adapted to be connected to a flush hose 79. When in the flush mode, the valve 73 will direct liquid refrigerant to the flush hose 79. The flush hose 79 connects to an input port in the air conditioning system. A return hose 81 connects to an output port in the air conditioning system. This enables the flushing liquid refrigerant to return from the air conditioning system to the return hose 81. Return hose 81 has a recovery branch hose 82 which is adapted to connect to the intake line 21 after flushing and when the manifold line 19 is removed.

At least one filter 83 locates at the end of the return hose 81 for filtering the liquid refrigerant being flushed through the air conditioning system. Filter 83 is much smaller than filter dryer 33, but has a much lower pressure drop. Consequently liquid refrigerant can be efficiently pumped through the filter 83 at a much higher rate than through filter dryer 33.

A check valve 85 downstream of filter 83 assures that the flow through the return hose 81 will only be in a returning direction. The check valve 85 is located in a return line 87. The return line 87 connects to the storage input line 51. The return line 87 will bypass the accumulator 25, filter dryer 33 compressor 41.

In the recovery operation, the hose 19 will be connected to the manifold 13. Hoses (not shown) from the high and low side of the air conditioning system will be connected to the high and low side connections 15, 17, respectively, of the manifold 13. Valves 23 and 39 will be open. Valve 77 will be closed. Pump 69 will not be operating. Compressor 41 will be turned on.

Refrigerant will flow from both the high and low side of the air conditioning system to the recovery apparatus 11. This refrigerant will be a mixture of liquid and gas, and it will flow through the intake hose 19 to the intake line 21. The accumulator 25 will separate oil from the refrigerant. Any liquid components in the refrigerant will be trapped, and will eventually boil off into a gas.

The refrigerant as a gas flows out the accumulator output line 29 and through the filter dryer 33. Moisture and impurities will be filtered by the filter dryer 33. The refrigerant will flow through the compressor input line 37 into compressor 41. Compressor 41 compresses the refrigerant to a high pressure, hot gas.

The high pressure gaseous refrigerant flows through oil separator 45 into condenser 47. Condenser 47 will condense the gaseous refrigerant into a high pressure liquid refrigerant. This refrigerant will flow through the storage input line 51 and the storage intake hose 59 into the storage container 63. The worker will continue withdrawing refrigerant until a selected level of vacuum has been achieved, assuring withdrawal of substantially all of the refrigerant from the air conditioning system.

Then, the worker will clean the refrigerant more thoroughly so that it can be reused or used for flushing In the cleaning mode, the compressor 41 will be turned off. The valves 23 and 39 will be closed. The valve 73 will be moved to a position to direct refrigerant to recirculation line 75. Valve 77 will be open. Pump 69 will be turned on.

Pump 69 will withdraw liquid refrigerant from the storage container 63, through withdrawal line 67 into the pump 69. The pump 69 pumps the liquid refrigerant out line 71. The valve 73 will direct the liquid refrigerant through line 75 and back in through the filter dryer 33. The filter dryer 33 will further clean the refrigerant. The refrigerant will flow out the filter dryer output line 35 and back into the storage input line 51. The solenoid valve 39 will prevent any of this liquid from flowing into the compressor input line 37. The refrigerant will flow through the storage input line 51 back into the storage container 63. The worker will continue this recirculation process until enough cycles have assured that the refrigerant is completely clean. One specification requires about 15 minutes of recirculation.

Then, the worker may wish to flush the air conditioning system of impurities. The worker will disconnect the hoses leading from the air conditioning system to the manifold connections 15, 17. He will connect the hoses 79, 81 to the same ports in the air conditioning system. He will connect the hose 82 to the intake line 21. The storage container 63 will need a quantity of clean liquid refrigerant that is approximately ten times the volume of the refrigerant recovered from the air conditioning system.

In the flush mode, valves 23 and 39 remain closed. Valve 77 will be closed. Valve 73 will be switched to the other position, blocking flow into the recirculation line 75. Liquid pump 69 will be turned on.

Liquid pump 69 will withdraw liquid refrigerant from the storage container 63. The liquid pump 69 discharges the liquid refrigerant through the flush line 71 into the flush hose 79 and into the air conditioning system. The liquid refrigerant will flow through the air conditioning system, cleaning it of impurities. This liquid refrigerant will return through the return hose 81 to the return line 87.

As the liquid refrigerant flows into the return line 87, it will pass through the filter 83. The filter 83 will separate the impurities collected during the flushing mode. The liquid refrigerant in the return line 87 will flow directly to the storage input line 51 and from there into the storage container 63. In the flushing mode, the filter dryer 33 is bypassed, as well as the accumulator 25 and compressor 41.

After cycling through the flush mode for a selected duration, the worker switches back to the recovery mode. The pump 69 will be turned off. Valve 77 closes and valves 23 and 39 open. The compressor 41 turns on.

The flushing refrigerant will be withdrawn from the air conditioning system through hoses 81 and 82. It will pass through intake line 21, accumulator 25, filter dryer 33, compressor 41, condenser 47 and into the storage container 63 in the manner described above.

The worker will then switch the recovery apparatus 11 back to the clean mode. The filter 83 may not be sufficient to completely clean the flushing refrigerant to specifications. He will repeat the cleaning cycle described above to clean the refrigerant in the storage container 63.

The invention has significant advantages. The invention enables the worker to flush the air conditioning system of impurities. No additional flushing fluid is required. The refrigerant collected can be used also for the flushing. This avoids requiring an aerosol flush, which results in venting to the atmosphere.

While the invention has been shown in only one of its forms, it should be apparent to those skilled in the art that it is not so limited, but is susceptible to various changes without departing from the scope of the invention.

I claim:

1. In a recovery apparatus adapted to be connected to an air conditioning system for recovering refrigerant from the air conditioning system, the recovery apparatus being of the type having a filter dryer for removing moisture and impurities from the refrigerant received from the air conditioning system, a compressor connected to the filter dryer for compressing refrigerant received from the filter dryer, a condenser connected to the compressor for condensing the compressed refrigerant into a liquid refrigerant, and a storage container connected to the condenser for receiving the liquid refrigerant, the improvement comprising in combination:

a liquid pump having an output and an input;

input means for connecting the pump to the storage container for pumping liquid purge refrigerant from the storage container;

output means for connecting the output of the pump to the air conditioning system for pumping the liquid purge refrigerant through the air conditioning system to flush the air conditioning system of impurities;

return means for bypassing the compressor and returning the liquid purge refrigerant being pumped through the air conditioning system to the storage container, leaving a quantity of the purge refrigerant in the air conditioning system once the pump is turned off; and means for disengaging the pump, the output means and the return means from the air conditioning system once purging is completed, and for causing the compressor to withdraw through the filter dryer the quantity of the purge refrigerant from the air conditioning system and pass it through the condenser to the storage container.

2. The recovery apparatus according to claim 1 further comprising filter means connected into the return means for filtering impurities from the refrigerant being returned to the storage container.

3. In a recovery apparatus adapted to be connected to an air conditioning system for recovering refrigerant from the air conditioning system, the recovery apparatus being of the type having a filter dryer for removing moisture and impurities from the refrigerant received from the air conditioning system, a compressor connected to the filter dryer for compressing refrigerant received from the filter dryer, a condenser connected to the compressor for condensing the compressed refrigerant into a liquid refrigerant, and a storage container connected to the condenser for receiving the liquid refrigerant, the improvement comprising in combination:

a liquid pump having an output and an input, the input adapted to be connected to the storage container for pumping liquid refrigerant from the storage container;

connection means for connecting the output of the pump to the air conditioning system for pumping the liquid refrigerant through the air conditioning system to flush the air conditioning system of impurities;

return means for returning the liquid refrigerant being pumped through the air conditioning system to the recovery apparatus for cleaning and replacement in the storage container;

means for selectively directing the liquid refrigerant being pumped from the output of the liquid pump to the filter dryer rather than to the air conditioning system; and means for selectively directing the liquid refrigerant flowing out of the filter dryer to the storage container rather than to the compressor, for cleaning the liquid refrigerant by circulating the liquid refrigerant with the liquid pump through the filter dryer.

4. A recovery apparatus adapted to be connected to an air conditioning system for recovering refrigerant from the air conditioning system, comprising in combination:

an accumulator for receiving the refrigerant from the air conditioning system and for trapping liquids and removing oil from the refrigerant;

a filter dryer connected to the accumulator for removing moisture and impurities from the refrigerant received from the accumulator;

a compressor having an input line connected to the filter dryer for compressing refrigerant received from the filter dryer;

a condenser having an input and an output, the input being connected to the compressor for condensing the compressed refrigerant into a liquid refrigerant;

a storage input line leading from the output of the condenser;

a storage container adapted to be connected to the storage input line for receiving the liquid refrigerant;

a liquid pump having an output and an input, the input adapted to be connected to the storage container for pumping liquid refrigerant from the storage container;

a flush line leading from the output of the liquid pump;

connection means for connecting the flush line to the air conditioning system for pumping the liquid refrigerant through the air conditioning system to flush the air conditioning system of impurities;

return means for returning the liquid refrigerant being pumped through the air conditioning system to the recovery apparatus for cleaning and replacement in the storage container;

first valve means in the flush line for selectively directing the liquid refrigerant being pumped by the liquid pump to the filter dryer rather than to the connection means; and second valve means in the input line of the compressor for selectively directing the liquid refrigerant from the filter dryer to the storage input line rather than to the compressor, to enable cleaning of the liquid refrigerant by circulating the liquid refrigerant with the liquid pump through the filter dryer.

5. The recovery apparatus according to claim 4 wherein the return means comprises:

a return line bypassing the accumulator, compressor, and filter dryer and leading directly to the storage input line; and return connection means for connecting the return line to the air conditioning system.

6. The recovery apparatus according to claim 5 further comprising:

a filter in the return line for filtering returning liquid refrigerant.

7. In a recovery apparatus adapted to be connected to an air conditioning system for recovering refrigerant from the air conditioning system, the recovery apparatus being of the type having an accumulator for trapping oil and liquid refrigerant from the air conditioning system, a filter dryer for removing moisture and impurities from the refrigerant received from the accumulator, a compressor having an input line connected to the filter dryer for compressing refrigerant received from the filter dryer, a condenser connected to the compressor for condensing the compressed refrigerant into a liquid refrigerant and supplying the liquid refrigerant to a storage input line, and a storage container adapted to be connected to the storage input line for receiving the liquid refrigerant, the improvement comprising in combination:

a liquid pump having an output and an input, the input adapted to be connected to the storage container for pumping liquid refrigerant from the storage container;

a flush line leading from the output of the liquid pump;

connection means for connecting the flush line to the air conditioning system for pumping the liquid refrigerant through the air conditioning system to flush the air conditioning system of impurities;

a return line bypassing the accumulator, compressor, and filter dryer and leading directly to the storage input line;

return connection means for connecting the return line to the air conditioning system;

a filter in the return line for filtering returning liquid refrigerant;

first valve means in the flush line for selectively directing the liquid refrigerant being pumped by the liquid pump to the filter dryer rather than to the connection means; and second valve means in the input line of the compressor for selectively directing the liquid refrigerant from the filter dryer to the storage input line rather than to the compressor, to enable cleaning of the liquid refrigerant by circulating the liquid refrigerant with the liquid pump through the filter dryer.

8. A method of recovering refrigerant from an air conditioning system and flushing the air conditioning system, comprising in combination:

withdrawing refrigerant from the air conditioning system;

filtering the withdrawn refrigerant;

compressing the filtered refrigerant;

condensing the compressed refrigerant into a liquid refrigerant;

placing the liquid refrigerant into a storage container; then pumping with a liquid pump the liquid refrigerant from the storage container back into the air conditioning system to flush the air conditioning system of impurities; and filtering and returning the liquid refrigerant being pumped through the air conditioning system to the storage container.

9. In a method of recovering refrigerant from an air conditioning system which withdraws refrigerant from the air conditioning system, filters the withdrawn refrigerant with a filter dryer, compresses the filtered refrigerant with a compressor, condenses the compressed refrigerant into a liquid refrigerant, and places the liquid refrigerant into a storage container, the improvement comprising;

pumping with a liquid pump the liquid refrigerant from the storage container back into the air conditioning system to flush the air conditioning system of impurities;

filtering and returning the liquid refrigerant being pumped through the air conditioning system to the storage container; and, to clean the liquid refrigerant in the storage container, directing the liquid refrigerant being pumped from the output of the liquid pump to the filter dryer rather than to the air conditioning system to clean the liquid refrigerant with the filter dryer; and directing the liquid refrigerant flowing out of the filter dryer to the storage container rather than to the compressor.

* * * * *

UNITED STATES PATENT AND TRADEMARK OFFICE

CERTIFICATE OF CORRECTION

PATENT NO. : 5,117,641
DATED : June 2, 1992
INVENTOR(S) : Robert L. Keltner

It is certified that error appears in the above-indentified patent and that said Letters Patent is hereby corrected as shown below:

Column 2, line 37, insert "." after the word "refrigerant".

Column 4, line 14, insert "." after the word "flushing".

Signed and Sealed this

Twelfth Day of April, 1994

Bruce Lehman

*Attest:*

BRUCE LEHMAN

*Commissioner of Patents and Trademarks*

*Attesting Officer*